United States Patent [19]

Zodrow

[11] 4,336,098

[45] Jun. 22, 1982

[54] LABELING STATION FOR A LABELING MACHINE, ESPECIALLY FOR BOTTLES

[75] Inventor: Rudolf Zodrow, Dusseldorf, Fed. Rep. of Germany

[73] Assignee: Jagenberg Werke AG, Dusseldorf, Fed. Rep. of Germany

[21] Appl. No.: 250,951

[22] Filed: Apr. 1, 1981

[30] Foreign Application Priority Data

Apr. 3, 1980 [DE] Fed. Rep. of Germany ..... 3013082

[51] Int. Cl.[3] ..... B65C 9/16

[52] U.S. Cl. ..... 156/568; 118/231; 156/571; 156/DIG. 32; 271/33

[58] Field of Search ..... 156/566, 567, 568, 571, 156/578, DIG. 29, DIG. 30, DIG. 31, DIG. 32; 118/220, 230, 231; 271/33

[56] References Cited

U.S. PATENT DOCUMENTS

| | | | |
|---|---|---|---|
| 3,532,585 | 10/1970 | Kronseder et al. | 156/568 |
| 4,092,207 | 5/1978 | Zodrow | 156/568 |
| 4,298,422 | 11/1981 | Zodrow | 156/568 |

*Primary Examiner*—Michael G. Wityshyn
*Attorney, Agent, or Firm*—Sprung, Horn, Kramer & Woods

[57] ABSTRACT

In a labeling machine having a labeling station including a support means for revolving the support about its axis successively past a gluing roller, a label pickup station and a label gripping cylinder, at least one gluing segment on the support axis, the gluing segment having a cylindrically curved pickup surface with a radius smaller than the distance between the support axis and the gripping cylinder, the gripper cylinder and each gluing segment being coupled to one another through a nonuniformity gearing such that they have the same sense of rotation and each gluing segment performing a rotatory movement in the opposite direction which is accelerated or retarded such that its pickup surface rolls against the glue roller, the labels and the gripper cylinder, the labeling station being designed for optional operation with one or more gluing segments and the nonuniformity gearing being replaceable such that the transmission ratio of the gearing from the support to the gripper cylinder is reciprocal to the number of gluing segments with which the support is provided and the division of the gripper cylinder, the improvement wherein the nonuniformity gearing comprises a stationary sun gear and a lantern-pinion gearing, each lantern pinion being fixedly coupled with the drive shaft of each gluing segment and being provided with trundles, the sun gear having teeth with the flanks of different steepness according to the acceleration or retardation of each gluing segment, at least the section of the sun gear which acts in the area of the gripper cylinder being interchangeable.

4 Claims, 6 Drawing Figures

LABELING STATION FOR A LABELING MACHINE, ESPECIALLY FOR BOTTLES

BACKGROUND

Figure 1:
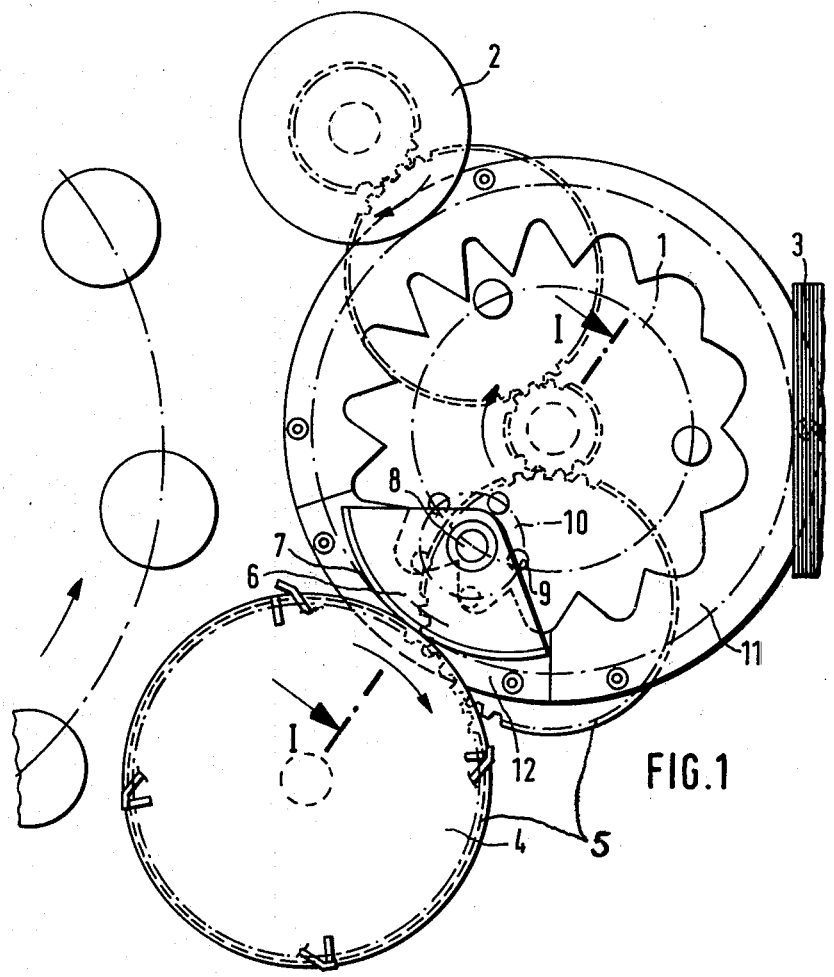

The invention relates to a labeling station of a labeling machine, especially for bottles, having one or more gluing segments which are mounted on a driven, revolving support, and whose axes of rotation are each situated on the support at a point between the pickup surface and the center of curvature of their curved pickup surface (the latter being especially cylindrically curved with a radius smaller than the distance between the support axis and the gripper cylinder), and revolve on a circular path concentric with the support axis, the support, the gripper cylinder and the gluing segments being coupled to one another through a cam drive such that they have the same sense of rotation and the gluing segments perform a rotatory movement in the opposite direction which is accelerated or retarded such that their pickup surfaces roll against the glue roller, the labels and the gripper cylinder, the labeling station being designed for optional operation with one or more gluing segments and the cam drive being replaceable such that the transmission ratio of the drive from the support to the gripper cylinder is reciprocal to the number of gluing segments installed on the support and the number of divisions of the gripper cylinder.

Such a labeling station is the subject of U.S. Pat. No. 4,092,207. The advantage of such a labeling station is that an optimum adaptation to the required labeling conditions is possible. If only a small output is required, the support is provided with only a single gluing segment which serves labels to all spaces on the multiple divisions of the gripper cylinder. This means that, for low outputs, only one gluing segment has to be kept available on one and the same support for each of a variety of label sizes. If a higher output is required, the support is adapted to this new operating situation by the simple installation of additional gluing segments and the replacement of the corresponding gears and cams. Before changing over from one label length to another label length, it is necessary only to replace the gluing segment and change the gearing. The serving of all spaces on the gripper cylinder is possible because the gluing segment supports and the gripper cylinder rotate in the same sense, but the gluing segment rotates in the opposite sense.

THE INVENTION

It is the object of the invention to improve a labeling station of the kind mentioned above, with respect to the exchangeability of the gear and cam drive.

This object is achieved in accordance with the invention by designing the cam drive as a lantern pinion drive in which every lantern pinion fixedly coupled to the drive shaft of the pickup element has trundles and whose stationary cam ring has cams in the form of teeth whose flanks vary in steepness according to the acceleration and/or retardation of the rotation required to produce the rolling movement of the gluing segment at the individual stations, and by making the section of the cam ring that acts in the area of the gripper cylinder interchangeable.

In a labeling station of this kind, the manufacture of the drive is not difficult or expensive, because the peculiar irregular rotation of the gluing segments is derived directly from the lantern pinion drive. This means that, for a different set of gluing segments on the support, in addition to the also necessary adaptation of the gear ratio by replacement of the gear train joining the support and gripper cylinder, only the portion of the cam ring that is in the area of the gripper cylinder needs to be replaced in order to produce the conditions required in the rolling action against the gripper cylinder when each space on the gripper cylinder, whose division remains the same, is to be fed. The pickup element or elements with their sets of trundles, however, remain unchanged.

The replacement of the cam ring or cam ring portion is especially simple, because the cam ring is internally toothed. In accordance with a further development of the invention, a gear drive is inserted between the lantern pinion of each gluing segment and the drive shaft of the gluing segment, if the number of teeth (cams) on the cam wheel is small in accordance with the ratio of the transmission. In that case, the ratio can be selected such that only one tooth or cam needs to be replaced as the replacement of the cam wheel portion.

An optimum adaptation of the individual stations to the label length to be applied, while allowing for an optimum output at the smallest possible machinery cost, is achieved when the division of the gripper cylinder is substantially equal to the length of the labels to be applied. The choice can then be made as to whether, according to the desired output, to provide the pickup spaces on the gripper cylinder with one, two or three or more gluing segments. The number of gluing segments then determines the transmission ratio. Thus, for example, it is possible to handle the labels of the same length with one, two or three gluing segments. In this case, if the gripper cylinder is divided into four divisions, the ratio of the transmission from the support to the gripper cylinder will be 4:1, 4:2 or 4:3. In any case, therefore, it is possible to obtain optimum transmission ratios with optimum utilization of the circumference of the gripper cylinder by selecting the number of gluing segments and adaptation of the transmission ratios.

Figure 2:
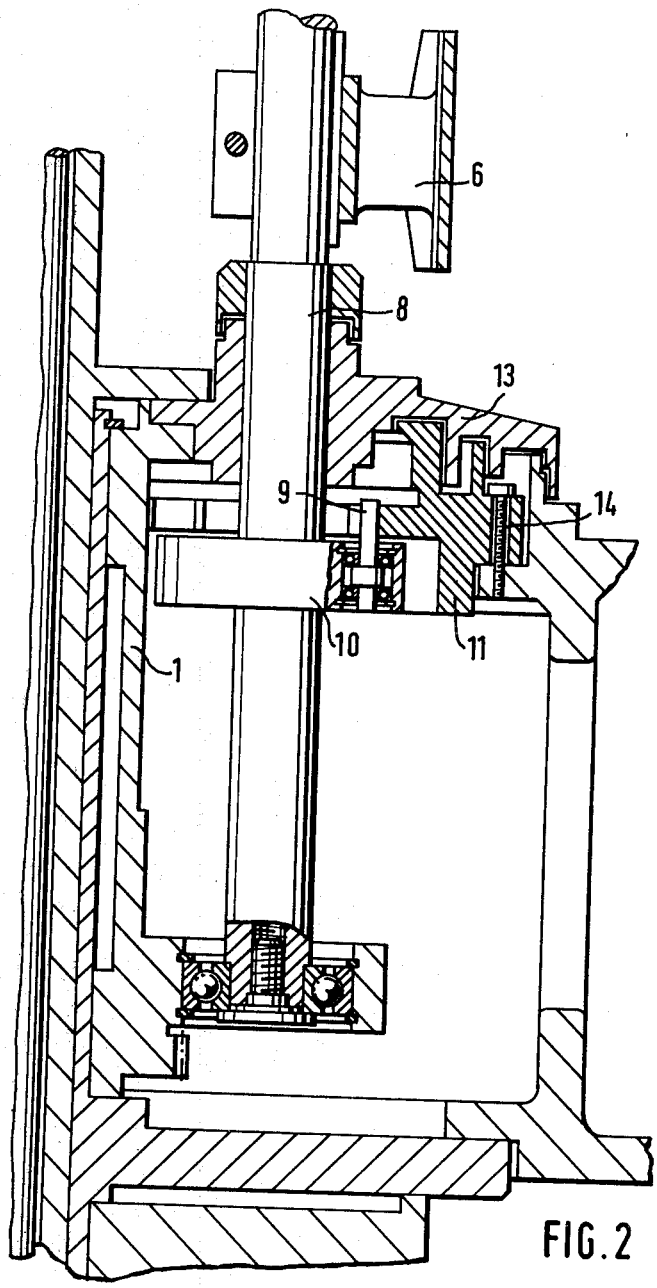
Figure 3:
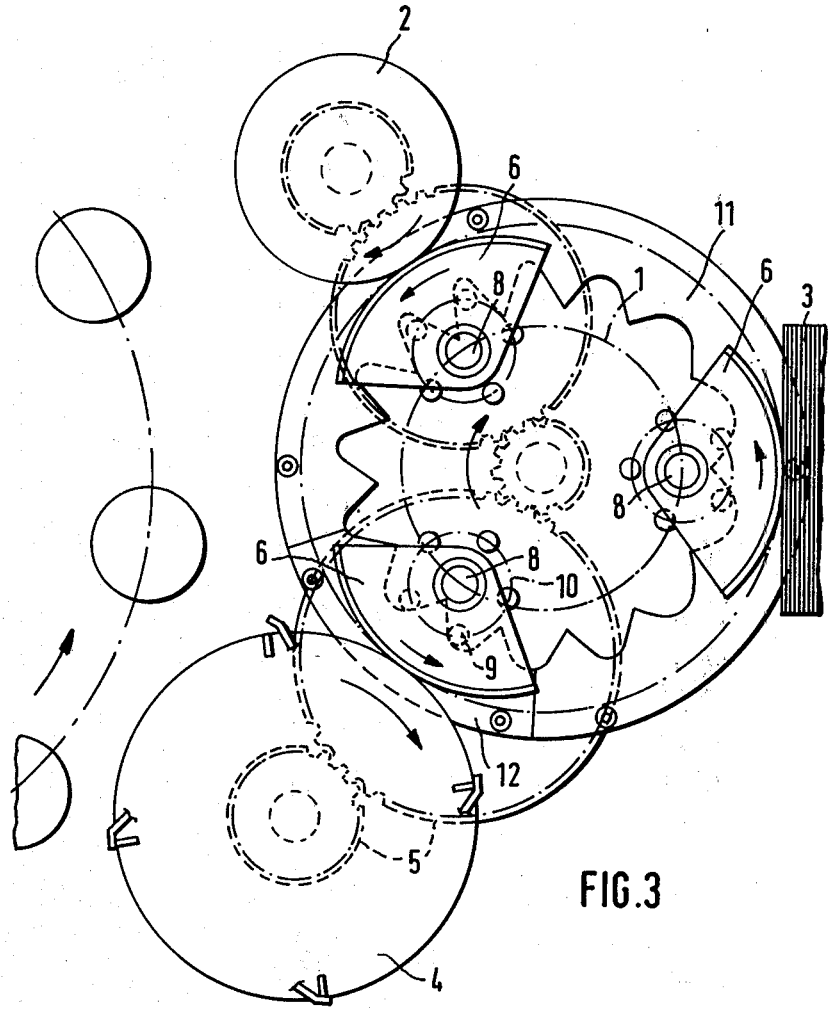
Figure 4:
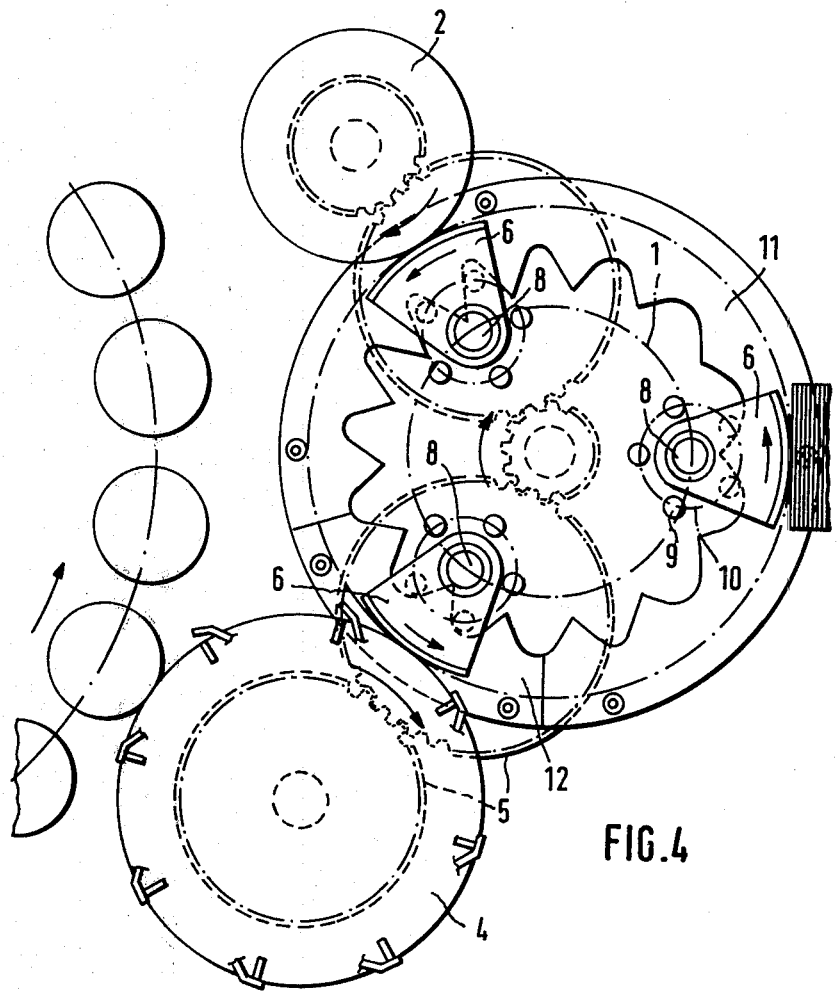
Figure 5:
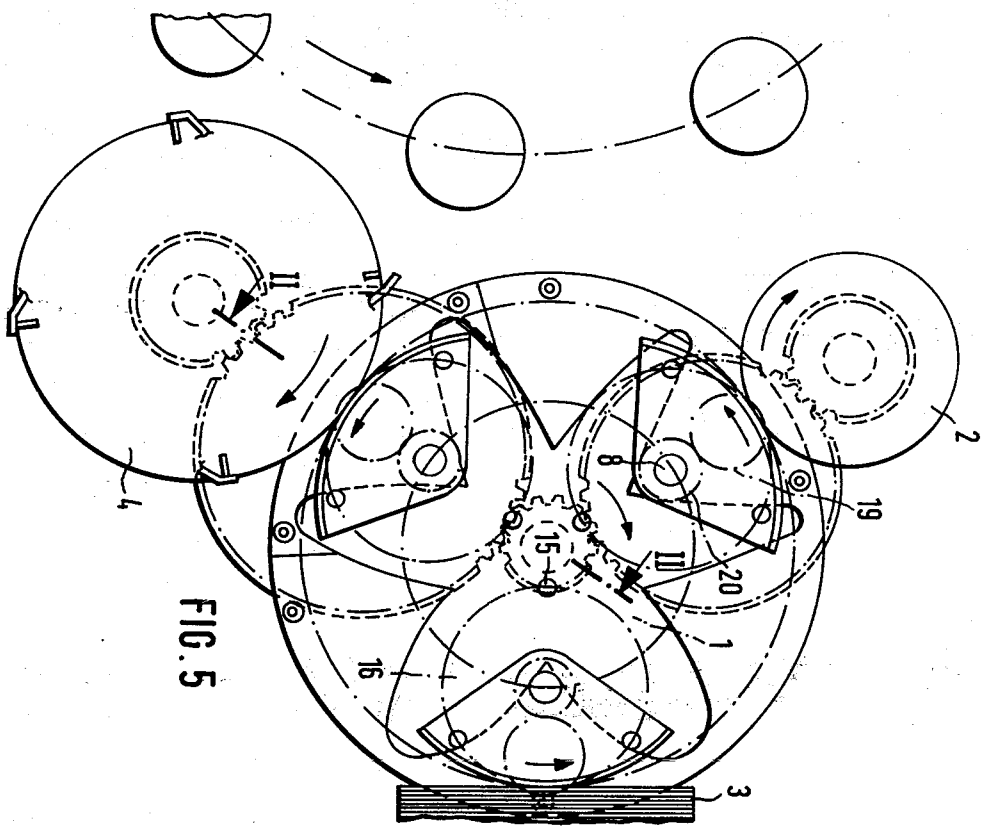
Figure 6:
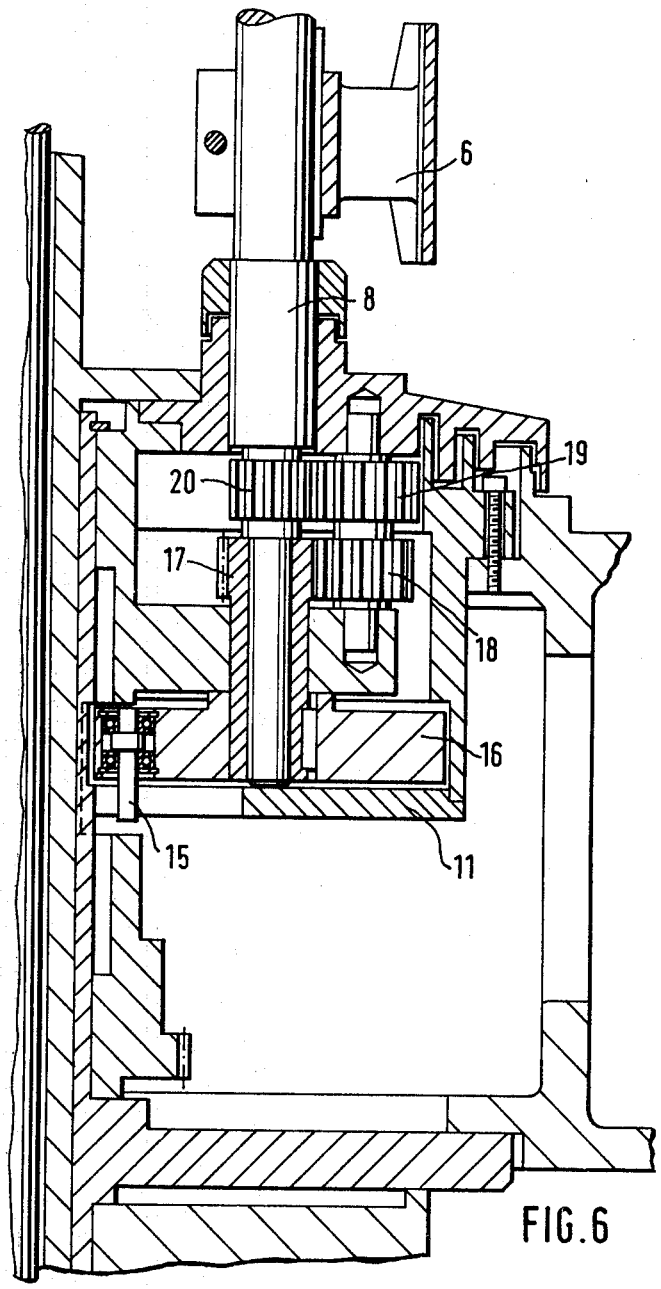

The invention will be further explained with the aid of drawings representing an embodiment, wherein:

FIG. 1 is a diagrammatic top plan view of a labeling station with a single gluing segment, FIG. 2 is half of an axial cross sectional view of the labeling station of FIG. 1, taken along line I—I thereof, FIG. 3 is a diagrammatic top plan view of the labeling station of FIG. 1 with three gluing segments, FIG. 4 represents the labeling station of FIG. 3 with three gluing segments having a different length from the gluing segments of FIG. 3, FIG. 5 is a diagrammatic top plan view of a labeling station having three pickup elements in a form different from that of FIG. 3, and FIG. 6 is half of an axial cross section of the labeling station of FIG. 5, taken along line II—II thereof.

The labeling stations represented in the embodiments are identical in their principal features, so that the description of the principal features can be limited to the embodiment shown in FIGS. 1 and 2. The differences will then be explained with reference to the individual embodiments.

The labeling station consists of a rotating gluing segment support 1 and stations disposed successively along its periphery, namely, a glue roller 2, a label magazine 3 and a gripper cylinder 4. The gripper cylinder 4 is coupled through a gear train 5 to the gluing segment support 1, so that the rotatory speeds of the gluing segment support 1 and of gripper cylinder 4 will be in a specific ratio to one another. This transmission ratio can be varied by changing the gears of the gear train 5.

The gluing segment support 1 bears a gluing segment 6. This gluing segment 6 has a cylindrically curved pickup surface 7 whose radius of curvature is smaller than the distance between the axis of the gluing segment support 1 and the periphery of the gripper cylinder 4. The gluing segment 6 is mounted for rotation by means of its drive shaft 8 whose axis is situated between the pickup surface 7 and the center of curvature of the segment and is symmetrical with the pickup surface. The drive consists of a lantern pinion drive, in which the trundles 9 of the lantern pinion 10 mesh with the internal cam teeth of a stationary cam ring 11. The steepness of the flanks of the cam teeth of the cam wheel 11 differs according to the acceleration or retardation required for the rolling movement of the gluing segment at the individual stations 2, 3 and 4. When the gluing segment support 1 rotates uniformly clockwise, this lantern pinion drive produces a nonuniform counterclockwise rotation of the gluing segment 6.

The length of the labels stored in the label magazine is substantially the same as the length of one pickup space on the gripper cylinder 4 which is quartered, i.e., has four spaces for picking up labels. This means that full use can be made of the circumference of the gripper cylinder 4 for the transfer of labels of a given length. Inasmuch as only one gluing segment 6 is provided for the serving of all of the pickup spaces on the gripper cylinder 4, the transmission ratio of the gluing segment support 1 to the gripper cylinder 4 amounts to 4:1.

In the embodiment represented in FIG. 3, which is the same in its geometrical dimensions as that of FIG. 1, labels of the same length are handled. It differs, however, from the previous embodiment in that, in this case, the gluing segment support 1 is equipped with three gluing segments uniformly spaced around it. The construction and the drive of the gluing segments 6 is the same as it is in FIGS. 1 and 2.

To enable the labeling station converted from a single gluing segment 6 to three gluing segments to handle the labels, it is necessary to change the gear train 5 so as to provide a transmission ratio of 4:3 between the gluing segment support and the gripper cylinder. To enable the gluing segment support 1 to roll against the gripper cylinder at this modified transmission ratio, it is furthermore necessary to replace the section 12 of the cam ring 11 with another section 12 having cam teeth of a different configuration or to replace the entire cam ring 11 with one having cam teeth of a different configuration in the section 12 adjacent the gripper cylinder 4.

The labeling station of the embodiment in FIG. 4 handles labels of a length different from that of the labels relating to FIGS. 1 to 3. In order in this case, too, to make full use of the circumference of the gripper cylinder, the gripper cylinder 4 is divided into eight spaces on account of the shorter label length. To be able to handle such shorter labels, it is necessary to change the gear train 5, so that a transmission ratio of 8:3 will result between the gripper cylinder 4 and the gluing segment support 1. It is also necessary to replace section 12 of the cam ring 11 with another section 12 having a different cam tooth configuration or to replace the entire cam ring 11 with one of a different cam tooth configuration in section 12.

Since the movements of the pickup element 6 against the gluing roller 2 and the label magazine 3 are independent of the number of gluing segments installed on the gluing segment support, and also independent of the division of the gripper cylinder 4, the cam tooth configuration of cam ring 11 remains unchanged in the area of the gluing roller 2 and of the label magazine 3. In other words, it is not necessary to replace the entire cam ring, and instead it suffices to replace section 12 thereof. As best seen in FIG. 2, the replacement of the cam ring 11, or of section 12 of cam ring 11, is easy to perform, particularly in the case of an internally toothed cam ring. It is necessary only to lift up a cover 13 and remove the cam ring from the machine casing after removing its bolt 14.

The embodiment of FIGS. 5 and 6 differs from the other embodiments in that a lantern pinion bearing the trundles 15 is not mounted fixedly on the drive shaft 8 of the pickup element, but is mounted rotatably thereon. The lantern pinion 16 is corotationally coupled with a pinion 17 which meshes with a gear 18 of a gear train rotatably mounted in the machine, the other gear 19 of the gear train meshing with a pinion 20 which is corotationally mounted on the drive shaft 8. The pinions 17 and 20 form, in conjunction with the gear train 18–19, a gear train such that the gluing segment 6 revolves several times upon each rotation of the lantern gear 16. On account of the gear train 17–20, the pitch of the teeth of the cam ring is substantially greater than the pitch of the teeth of the cam rings of the other embodiments. If a "straddle" is maintained, i.e., if the rotatory position at each point of the pickup element is established by at least two engaged trundles, it is possible in this embodiment to have no more than a very small number of trundles, e.g., three trundles. Since the cam teeth are relatively large, it is possible in this embodiment that the exchange of only one cam tooth in the cam ring will suffice if there is to be a change in the division or in the case of a different gluing segment or set of gluing segments.

As indicated in FIG. 6 by the perpendicular broken line, the cam ring 11 is fastened by bolts for easy removal, and it can easily be removed and replaced through the side window in the casing.

It will be appreciated that the instant specification and examples are set forth by way of illustration and not limitation, and that various modifications and changes may be made without departing from the spirit and scope of the present invention.

I claim:

1. In a labeling machine having a labeling station including a support means for revolving the support about its axis successively past a gluing station, a label storage station and a label gripping cylinder, at least one gluing segment rotatably mounted on the support and moving on a circular orbit with the support axis as center, the gluing segment having a cylindrically curved pickup surface with a radius smaller than the distance between the support axis and the gripping cylinder, the support and the gripping cylinders and each gluing segment being coupled to one another through a nonuniformity gearing such that the gripping cylinder and the support have the same sense of rotation and each gluing segment performing a rotatory movement in the opposite direction which is accelerated or retarded such that its pickup surface rolls against the gluing station, the label storage station and the gripping cylinder, the labeling station being designed for optional operation with one or more gluing segments and the nonuniformity gearing being replaceable such that the transmission ratio of the gearing from the support to the gripping cylinder is reciprocal to the number of gluing segments with which the support is provided and the division of the gripping cylinder, the improvement wherein the nonuniformity gearing comprises a stationary sun gear and a lantern pinion gearing, each lantern pinion being fixedly coupled with the drive shaft of each gluing segment and being provided with lanterns, the sun gear having teeth with the flanks of different steepness according to the acceleration or retardation in individual rotation which is required for the rolling movement of each gluing segment at the gluing station, label storage station and gripping cylinder, at least the section of the sun gear which acts in the area of the gripping cylinder being interchangeable.

2. A labeling station according to claim 1, wherein the sun gear is internally toothed.

3. A labeling station according to claim 1, wherein the lantern gear of each gluing segment is operatively coupled to the drive shaft of that segment through a gear train.

4. A labeling station according to claim 1, wherein the distance on the gripping cylinder between successive gripping points is substantially equal to the length of the labels being gripped.

* * * * *